US012220739B2

(12) United States Patent
Stuart et al.

(10) Patent No.: US 12,220,739 B2
(45) Date of Patent: Feb. 11, 2025

(54) TABLE ASSEMBLY FOR PRESS BRAKE SYSTEM

(71) Applicant: Schweitzer Engineering Laboratories, Inc., Pullman, WA (US)

(72) Inventors: Josh Stuart, Peck, ID (US); Chris Emmel, Pullman, WA (US); Steve Barner, Pullman, WA (US); Kyle Garrett, Lewiston, ID (US); Aaron Snyder, Lewiston, ID (US); Jason Schacher, Lewiston, ID (US)

(73) Assignee: Schweitzer Engineering Laboratories, inc., Pullman, WA (US)

( * ) Notice: Subject to any disclaimer, the term of this patent is extended or adjusted under 35 U.S.C. 154(b) by 317 days.

(21) Appl. No.: 17/821,250

(22) Filed: Aug. 22, 2022

(65) Prior Publication Data

US 2024/0058855 A1 Feb. 22, 2024

(51) Int. Cl.
*B25B 5/00* (2006.01)
*B21D 5/04* (2006.01)

(52) U.S. Cl.
CPC ..... *B21D 5/04* (2013.01)

(58) Field of Classification Search
CPC .... B25B 1/00; B25B 1/02; B25B 5/00; B25B 1/20; B25B 5/02; B21D 5/04
See application file for complete search history.

(56) References Cited

U.S. PATENT DOCUMENTS

| | | | | |
|---|---|---|---|---|
| 9,186,777 | B2 * | 11/2015 | Woods | B25B 5/04 |
| 10,471,768 | B1 * | 11/2019 | Lindsay | B44B 3/065 |
| 2010/0295227 | A1 * | 11/2010 | Hung | B25B 1/103 269/244 |
| 2016/0016267 | A1 * | 1/2016 | Beatty | B23K 37/0452 29/559 |
| 2022/0388101 | A1 * | 12/2022 | Hanschmann | B23K 26/08 |
| 2024/0058855 | A1 * | 2/2024 | Stuart | B25H 1/02 |

* cited by examiner

*Primary Examiner* — Lee D Wilson
(74) *Attorney, Agent, or Firm* — Fletcher Yoder, P.C.

(57) ABSTRACT

A table assembly is used to support a workpiece to facilitate bending of the workpiece. The table assembly is attached to a press brake system and include a base and a clamp. The clamp is movable relative to the base to enable placement of the workpiece onto the base, and the clamp secures the workpiece to the base to block relative movement between the workpiece and the press brake system without additional user operations. The workpiece is secured via the table assembly without a manual force (e.g., to hold the workpiece in place) while the press brake system operates to bend the workpiece. The table assembly reduces, limits, or eliminates certain user operations during metalworking. The table assembly improves user experience (e.g., reduce an amount of manual labor) and/or efficiency associated with press brake operations.

20 Claims, 6 Drawing Sheets

TABLE ASSEMBLY FOR PRESS BRAKE SYSTEM

BACKGROUND

This disclosure relates to a metalworking system. More particularly, this disclosure relates to a table assembly for supporting a workpiece to facilitate press brake operations being performed on the workpiece.

Metal is a common material used in many different applications, such as electrical, automotive, infrastructure, and other implementations. Indeed, metal provides various desirable properties, such as strength and malleability, for usage in such applications. In some embodiments, metal may be produced and/or refined, such as via a smelting operation, and then shaped into a usable shape or profile, such as via a metalworking operation. An example metalworking operation includes a press brake operation used for bending a metal workpiece, such as sheet metal. However, traditional press brake operations may be tedious and/or cumbersome. For instance, a user may manually hold a workpiece during each press brake operation to secure the workpiece and ensure that the press brake bends the workpiece in a desirable manner to form a finished product. That is, the user may exert a substantial amount of physical force during press brake operations, which may affect user performance to enable desirable press brake operations. By way of example, a user may become fatigued over time and may not secure the workpiece as desired for as press brake operation. As a result, a finished product formed via the press brake operation may be undesirable.

DETAILED DESCRIPTION

Figure 1:
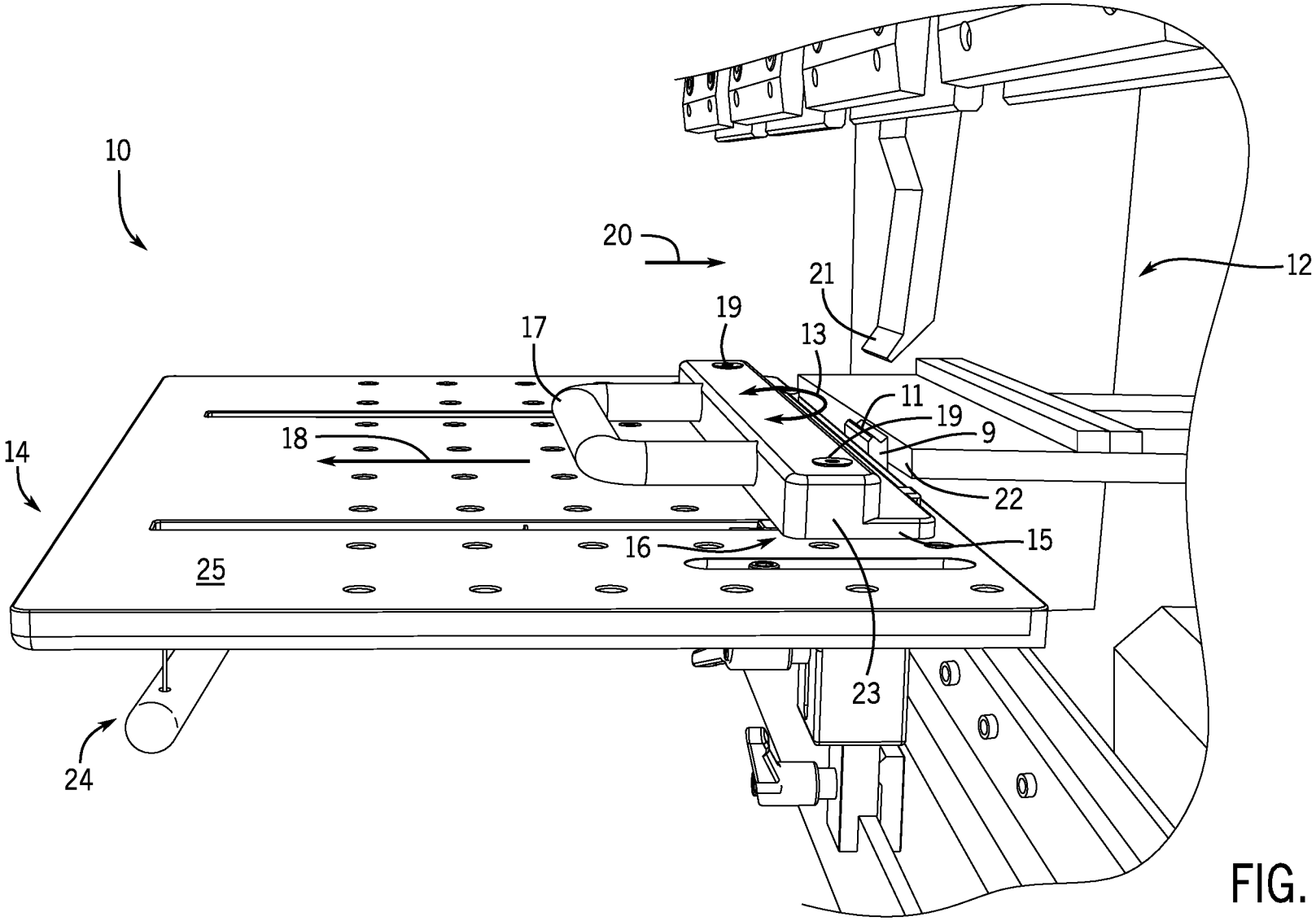
FIG. 1 is a perspective view of an embodiment of a table assembly for a press brake system, in accordance with an aspect of the present disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase "A or B" is intended to mean A, B, or both A and B.

The present disclosure relates a metalworking system (e.g., a system that shapes a metal workpiece), such as a press brake system that may bend metal. The press brake system may include a punch that may be movable to engage with (e.g., press, compress) a workpiece being manufactured. Engagement between the punch and the workpiece may impart a force onto the workpiece to cause the workpiece to bend. For instance, a portion of the workpiece may extend across a die of the press brake system. The punch may impart the force onto the portion of the workpiece to drive the workpiece into the die to bend the workpiece based on a configuration or geometry of the die.

Traditional press brake operations may include substantial manual operations that may be physically performed by a user. For example, a user may arrange the workpiece in a desirable position with respect to the die and/or the punch, the user may hold the workpiece at the desirable position while the punch moves with respect to the die, and the user may guide movement of the workpiece as the punch engages with the workpiece to ensure that bending of the workpiece is desirable. Such operations performed by the user may be tedious, cumbersome, and/or laborious. For instance, the user may utilize significant physical force and concentration to ensure that the workpiece is bent as desired. Additionally or alternatively, certain manual operations may be inefficiently performed. As an example, it may be time-consuming to position the workpiece in a desirable manner with respect to the punch and/or to the die for desirable press brake operations. For this reason, existing press brake operations may not efficiently bend a workpiece.

Thus, it is presently recognized that improving press brake operations may provide benefits associated with metalworking. Thus, embodiments of the present disclosure include a table assembly for supporting a workpiece to facilitate bending of the workpiece. For example, the table assembly may be attached to the press brake system and may include a base and a clamp. The clamp may be manually movable relative to the base to enable placement of the workpiece onto the base, and the clamp may secure the workpiece to the base to block relative movement between the workpiece and the press brake system without additional user operations. In other words, the workpiece may be secured via the table assembly without a manual force (e.g., to hold the workpiece in place) while the press brake system operates to bend the workpiece. Thus, the table assembly may reduce, limit, or eliminate certain user operations during metalworking. For this reason, the table assembly may improve user experience (e.g., reduce an amount of manual labor) and/or efficiency associated with press brake operations.

Turning to the drawings, FIG. 1 is a perspective view of an embodiment of a table assembly 10 attached to a press brake system 12. The table assembly 10 includes a base 14, which may be secured to the press brake system 12. A clamp 16 is movably coupled to the base 14 and may move (e.g., translate) relative to the base 14. For example, the clamp 16 may have a handle 17, which may be used (e.g., gripped) by an operator to manually move the clamp 16 along a first direction 18. For this reason, the handle 17 may have a geometry, such as a loop or U-shape, to enable the operator to grip the handle 17 to move the clamp 16 along the first direction 18. In some embodiments, the clamp 16 may be coupled to bearings (not shown), such as linear bearings, via pins 19. The pins 19 may be inserted through openings of the clamp 16, and the pins 19 may provide a force that compresses the clamp 16 toward the bearings to couple the clamp 16 and the bearings to one another. The bearings may facilitate movement of the clamp 16 along the base 14. For example, as described herein, the bearings may be movable relative to the base 14, and the bearings may move along guides that facilitate movement of the bearings along the first direction 18. Thus, the bearings may facilitate movement of the clamp 16, as driven by a manual force applied to the handle 17, in the first direction 18 via movement of the bearings along the guides.

The clamp 16 may facilitate positioning of a workpiece for the press brake system 12. For example, the clamp 16 may be moved in the first direction 18 to enable receipt of the workpiece between the clamp 16 and a backgauge 22 of the press brake system 12. That is, movement of the clamp 16 in the first direction 18 may move the clamp 16 away from the backgauge 22 to increase a distance between the clamp 16 and the backgauge 22. Upon release of a force (e.g., a physically applied force) used to pull the clamp 16 in the first direction 18, the clamp 16 may move in a second direction 20 toward the backgauge 22 to reduce the distance between the clamp 16 and the backgauge 22. For instance, as described herein, a biasing force (e.g., a spring force) may drive the clamp 16 in the second direction 20 in the absence of the force to move the clamp 16 in the first direction 18. Movement of the clamp 16 in the second direction 20 may compress the workpiece against the backgauge 22. Thus, the clamp 16 and the backgauge 22 may capture the workpiece to secure the workpiece and block movement between the workpiece and the base 14.

Such positioning of the workpiece between the clamp 16 and the backgauge 22 may also cause a portion of the workpiece to extend over a die 9 of the press brake system 12. The die 9 may have a v-shaped configuration forming a recess 11. During operation of the press brake system 12, a punch 21 may be moved toward the die 9 and the workpiece secured by the clamp 16. The punch 21 may engage with the workpiece and impart a force that extends the workpiece into the recess 11 of the die 9 to cause the workpiece to bend. Bending of the workpiece may cause the workpiece to move out of engagement with the clamp 16 to avoid the contact between the clamp 16 and the workpiece from affecting the press brake operation (e.g., to block the contact between the clamp 16 and the workpiece from imparting additional resistance onto bending movement of the workpiece). For this reason, the force imparted by the clamp 16 to secure the workpiece may be below a threshold value to enable release of the securement during operation of the press brake system 12 and facilitate completion of the bending of the workpiece.

In some embodiments, the clamp 16 may be movable to accommodate differently shaped workpieces. For example, the pins 19 may be movable relative to one another (e.g., the bearings to which the pins 19 are coupled may be movable relative to one another) to enable some rotation of the clamp 16 in one or more rotational directions 13 with respect to the base 14. Such movement of the clamp 16 may enable adjustment of an orientation of the clamp 16 to abut or contact (e.g., be flush with) a greater amount of surface area of the workpiece to provide greater securement of the workpiece between the clamp 16 and the backgauge 22.

The pins 19 may also facilitate easy installation and/or removal of the clamp 16 with respect to the table assembly 10. By way of example, the pins 19 may be decoupled from the bearings and removed from the openings of the clamp 16 to enable the clamp 16 to be removed from the table assembly 10. The pins 19 may then be coupled to another clamp 16, such as a clamp 16 having a different profile or embodiment, to implement the other clamp 16 to the table assembly 10. For instance, a specific clamp 16 (e.g., a clamp 16 having a particular geometric shape) may be selected and implemented to facilitate securement of a particular workpiece for press brake operations. The pins 19 may therefore facilitate usage of clamps 16 to secure different workpieces.

In the illustrated embodiment, the clamp 16 has a step-like profile with a first portion 15 (e.g., an engagement portion) and a second portion 23 (e.g., a handle portion). The first portion 15 may be in contact with the workpiece, and the second portion 23 may be coupled to the handle 17. The first portion 15 may have a first thickness, and the second portion 23 may have a second thickness that is greater than the first thickness. For example, the second, greater thickness may enable the second portion 23 accommodate a geometry of the handle 17. The first, smaller thickness facilitate bending of the workpiece. For instance, the smaller thickness may reduce an amount of travel of the workpiece, as caused by initial bending of the workpiece, to move out of engagement or contact with the clamp 16 and facilitate additional bending of the workpiece to complete the press brake operation. In this manner, continued contact between the workpiece and the clamp during the press brake operation that may otherwise occur for a clamp having a thicker first portion 15 may be avoided to reduce impacting the press brake operation. However, in additional or alternative embodiments, the clamp 16 may have any other suitable profile (e.g., curved surfaces) to facilitate securement of workpieces.

It should be noted that the clamp 16 may be made of any suitable material (e.g., metal, glass, plastic, composite, polymer) to facilitate securement of a workpiece. For example, the material of the clamp 16 may be of a sufficient strength and/or hardness to secure the workpiece in place during the press brake operation. In one embodiment, the clamp 16 may be made of a material (e.g., Delrin) that avoids scratching or affecting the structural integrity of the workpiece and/or that may have a low coefficient of friction on its surface to enable movement of the workpiece across the clamp 16 during bending to move the workpiece out of engagement with the clamp 16.

The base 14 may also be made of any suitable material to facilitate support of the clamp 16 and/or the work piece. The base 14 may also have a first surface 25 (e.g., a top surface, a workpiece surface, a primary surface) that facilitates movement of the clamp 16 and/or placement of the workpiece on the base 14. For example, the first surface 25 may be machined to have a smooth and uniform (e.g., planar) profile to enable movement of the clamp 16 along the first surface 25 and placement of the workpiece against (e.g., in flush contact with) the base 14. In some embodiments, the base 14 may have formations, such as openings, pockets, recesses, or holes to reduce a weight of the base 14.

In some embodiments, the table assembly 10 may further include a weight balancing system 24 that may facilitate movement of the clamp 16. As further described herein, the weight balancing system 24 may apply a force (e.g., a tensile force) that facilitates movement of the clamp 16 along the first direction 18, such as cooperative movement of the pins 19 along the first direction. The force imparted by the weight balancing system 24 may also be used to secure the positioning of the clamp 16 with respect to the backgauge 22 by blocking excessive movement of the clamp 16 in the second direction 20 toward the backgauge 22.

Figure 2:
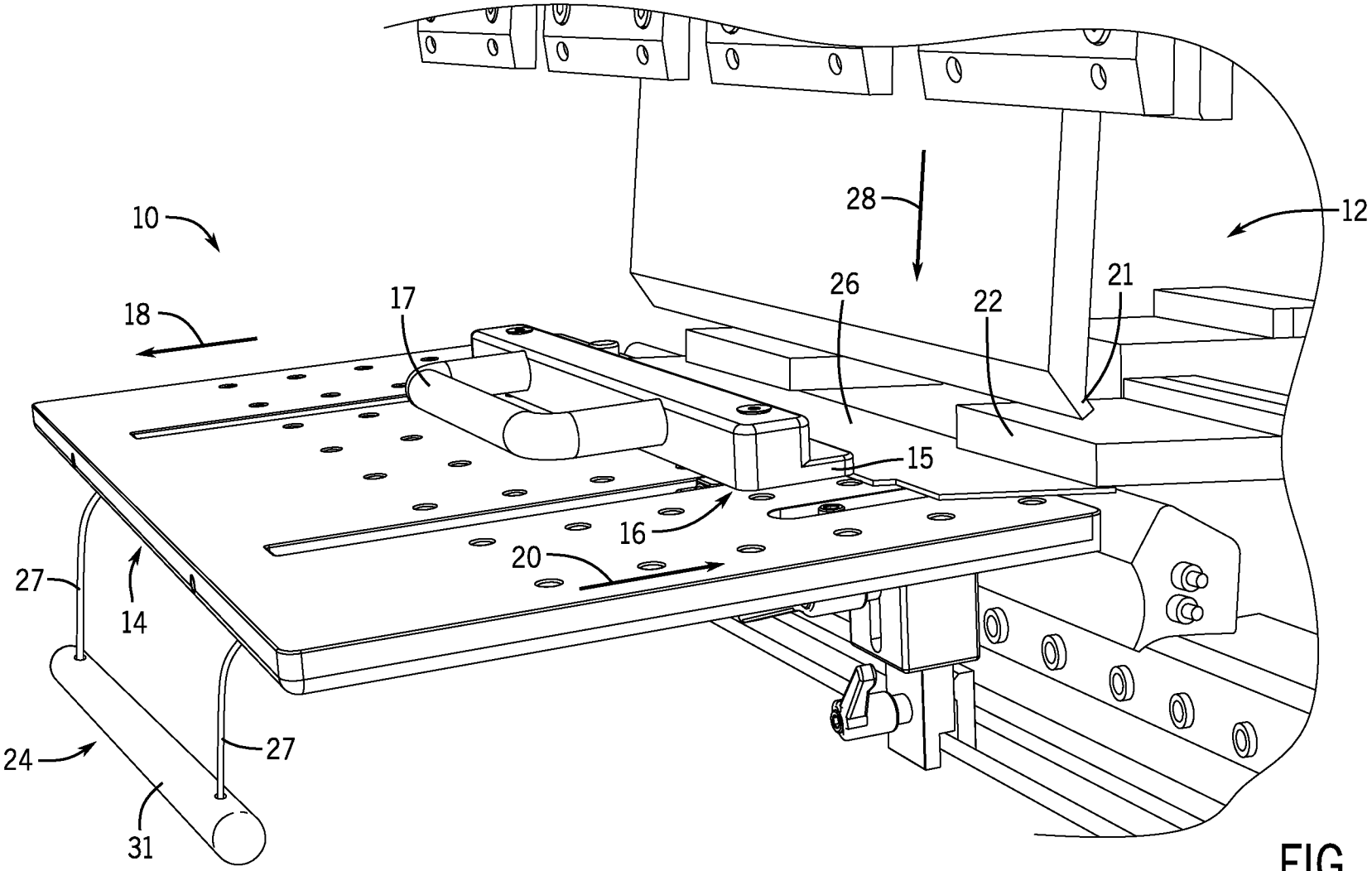
FIG. 2 is a perspective view of an embodiment of the table assembly of FIG. 1 during operation of the press brake system, in accordance with an aspect of the present disclosure.

FIG. 2 is a perspective view of an embodiment of the table assembly 10 with a workpiece 26 secured between the clamp 16 of the table assembly 10 and the backgauge 22 of the press brake system 12. As an example, a portion of the workpiece 26 may extend between the punch 21 and the die 9 (not shown). Thus, movement of the punch 21 in a third direction 28 (e.g., a downward direction) may cause the punch 21 to engage with the workpiece 26 to press the workpiece 26 against the die 9. As a result, the punch 21 may extend the workpiece 26 into the recess 11 of the die 9 to cause the workpiece 26 to bend. Such arrangement of the workpiece 26 via the punch 21 may impart some force onto the clamp 16 to cause the clamp 16 to move in the first direction 18 and enable the workpiece 26 to bend. Sufficient bending of the workpiece 26 may cause the workpiece 26 to move out of engagement with the clamp 16 to facilitate further bending of the workpiece 26.

The illustrated weight balancing system 24 is coupled to linkages 27 that may be coupled to the bearings to which the clamp 16 is secured. The weight balancing system 24 may include a weight 31 (e.g., a bar, a mass) that imparts a force onto the linkages 27 (e.g., via a gravitational force), which imparts a corresponding force onto the bearings and the clamp 16 in the first direction 18. Such a force may block movement of the clamp 16 in the second direction 20 within a threshold distance of the backgauge 22. That is, the force imparted by the weight 31 along the first direction 18 may offset a portion of the force (e.g., spring force) biasing the clamp 16 in the second direction 20 to position the clamp 16 at above the threshold distance away from the backgauge 22. Thus, contact between the clamp 16 and the press brake system 12 (e.g., the die 9, the backgauge 22) may be avoided to maintain a structural integrity of the clamp 16 and/or of the press brake system 12.

Figure 3:
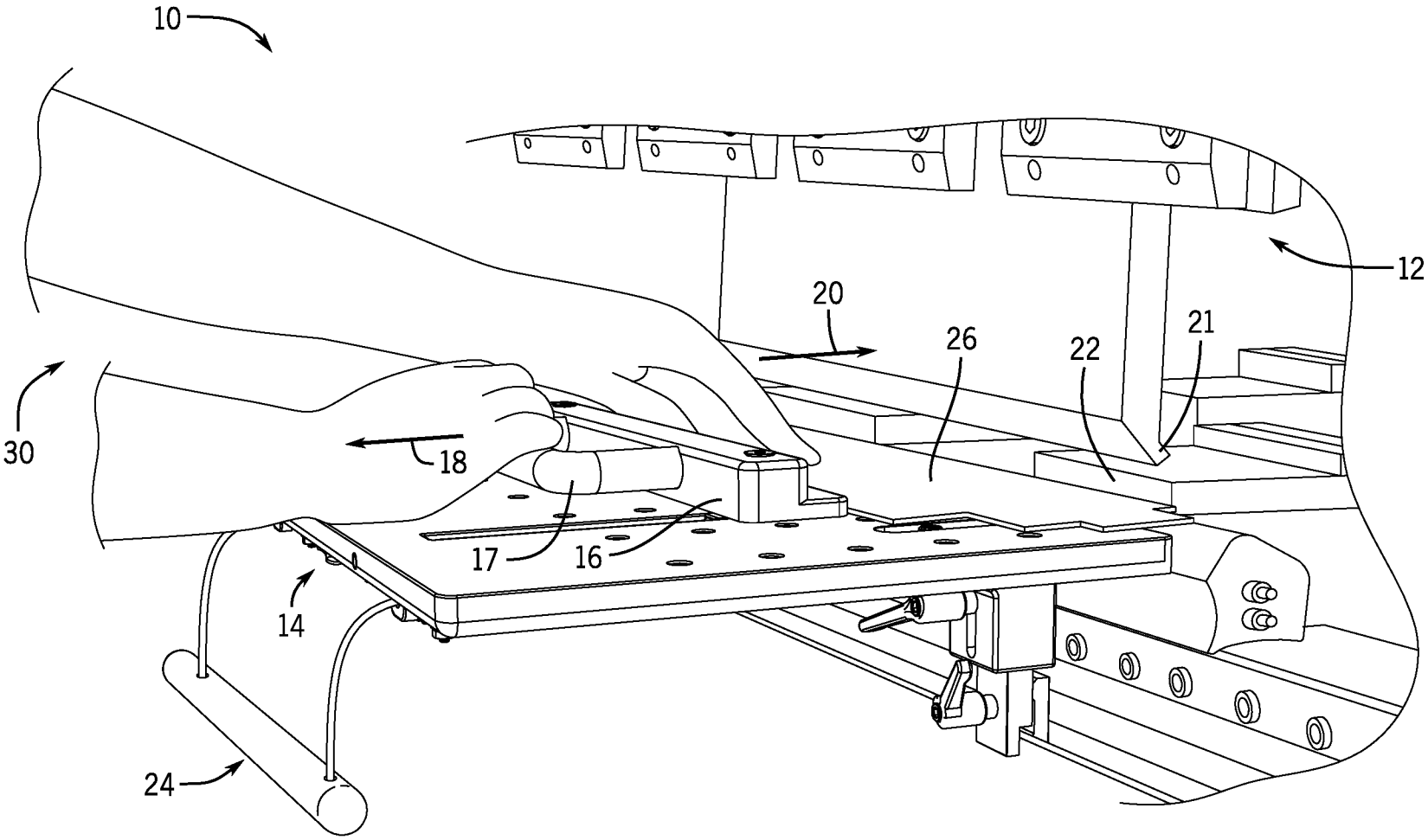
FIG. 3 is a perspective view of an embodiment of the table assembly of FIG. 1 with an operator utilizing the table assembly, in accordance with an aspect of the present disclosure.

FIG. 3 is a perspective view of an embodiment of the table assembly 10 with an operator 30 (e.g., a person, a robot) utilizing the table assembly 10. For instance, the operator 30 may use the table assembly 10 to prepare the workpiece 26 for press brake operations via the press brake system 12. By way of example, while operation of the press brake system 12 is suspended, the operator 30 may pull the handle 17 of the clamp 16 along the first direction 18 and place the workpiece 26 between the clamp 16 and the backgauge 22. For instance, the press brake system 12 may enable translation of the clamp 16 between a range of distances (e.g., 2.5 centimeters (cm) or 1 inch (in) to 15 cm or 6 in, 5 cm or 2 in to 25 cm or 10 in, 10 cm or 4 in to 33 cm or 13 in) along the first direction 18. Indeed, the clamp 16 may be movable along the base 14 to enable placement of any suitably sized workpiece 26 between the clamp 16 and the backgauge 22.

After placing the workpiece 26 at the appropriate position (e.g., against the backgauge 22), the operator 30 may release the clamp 16, and the clamp 16 may be biased to translate along the second direction 20 toward the backgauge 22 to abut the workpiece 26 against the backgauge 22. As such, the clamp 16 and the backgauge 22 may capture the workpiece 26 therebetween to secure the workpiece 26. After the workpiece 26 has been secured between the clamp 16 and the backgauge 22, the operator 30 may no longer hold the workpiece 26 in place. That is, the clamp 16 may block movement of the workpiece 26 without user involvement. As such, the table assembly 10 may reduce manual operations to be performed by the operator 30, such as having to maneuver around the punch 21 to secure the workpiece 26 during a press brake operation.

Figure 4:
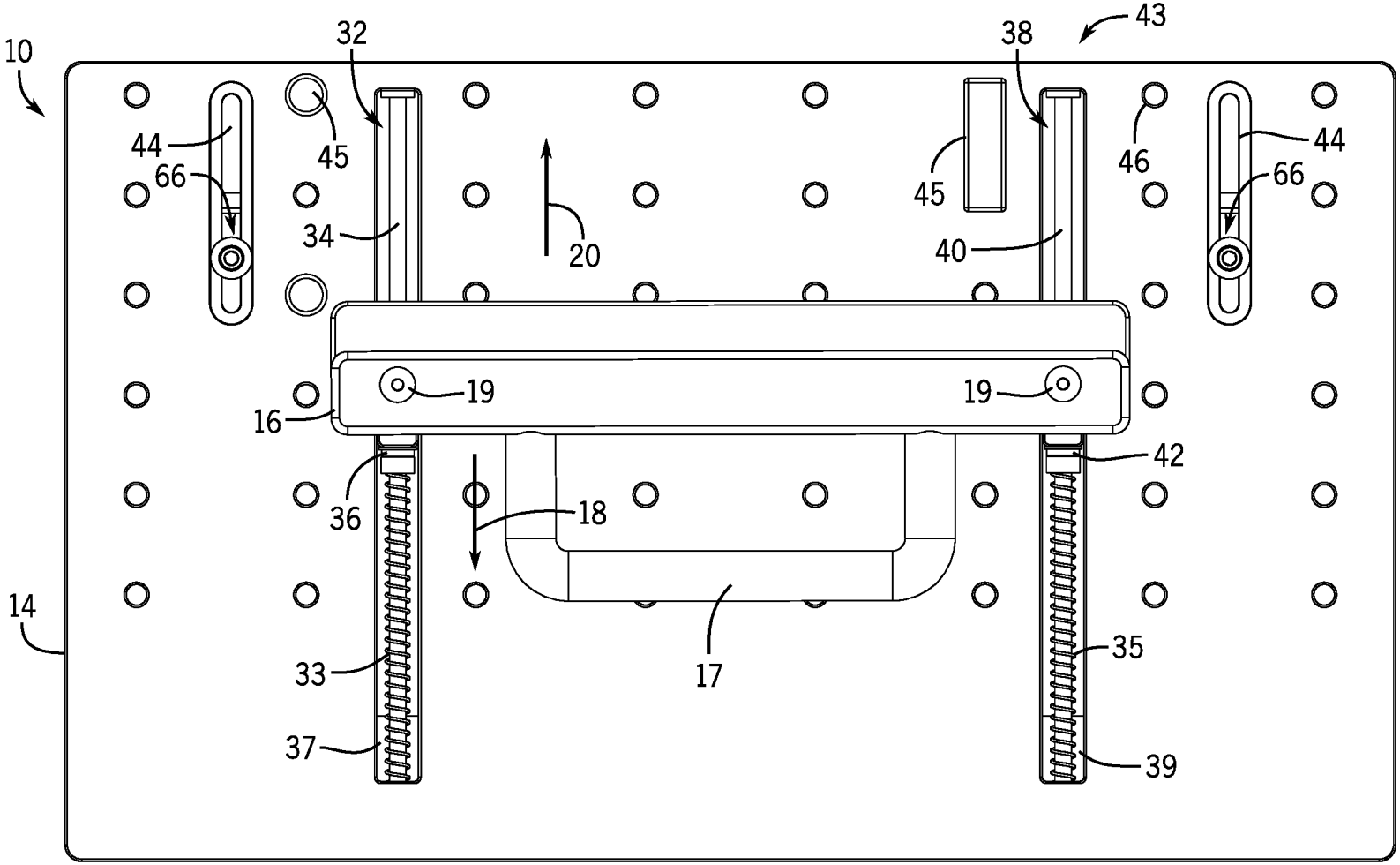
FIG. 4 is a top view of an embodiment of the table assembly of FIG. 1, in accordance with an aspect of the present disclosure.

FIG. 4 is a top view of an embodiment of the table assembly 10. The base 14 may include a first slot 32 (e.g., a first opening, a first aperture) and a first rod 34 installed within and extending along the first slot 32. A first bearing 36 may move along the first rod 34 and along a second surface 29 (e.g., a bottom surface, an underside, a secondary surface), which may be opposite the first surface 25. For instance, the first rod 34 may extend through an opening of the first bearing 36 and may guide movement of the first bearing 36 along the first rod 34. Thus, the first rod 34 may enable movement of the bearing 36 along the first slot 32 and the base 14, such as linearly along the first direction 18 and/or along the second direction 20. The base 14 may also include a second slot 38 (e.g., a second opening, a second aperture) and a second rod 40 installed within and extending along the second slot 38. A second bearing 42 may move along the second rod 40, which may extend through an opening of the second bearing 42 and guide movement of the second bearing 42 along the second rod 40 (e.g., along the first direction 18, along the second direction 20). The first bearing 36 and the second bearing 42 may be coupled to the clamp 16 via the pins 19. As such, movement of the bearings 36, 42 along the rods 34, 40, respectively, may drive corresponding movement of the clamp 16 along the rods 34, 40 and relative to the base 14.

The table assembly 10 may include a first biasing member 33 (e.g., a first mechanical spring, a first coil spring, a first helical spring) coiled around the first rod 34 and a second biasing member 35 (e.g., a second mechanical spring, a second coil spring, a second helical spring) coiled around the second rod 40. The first biasing member 33 may extend between the first bearing 36 and a first wall 37 within the first slot 32, and the second biasing member 35 may extend between the second bearing 42 and a second wall 39 within the second slot 38. For example, the first biasing member 33 may extend from the first bearing 36 toward a first side 41 (e.g., an externally facing side, a side facing away from the backgauge 22) of the base 14, opposite a second side 43 (e.g., a backgauge facing side) of the base 14. The biasing members 33, 35 may impart a force onto the bearings 36, 42 in the second direction 20 to urge movement of the bearings 36, 42, and therefore of the clamp 16, toward the second side 43 (e.g., toward the backgauge 22). As such, absent a force (e.g., a physically applied force) imparted onto the clamp 16 in the first direction 18, the clamp 16 may be maintained at a threshold distance away from the backgauge 22.

Movement of the clamp 16 in the first direction 18 may be effectuated by overcoming the force imparted onto the clamp 16 in the second direction 20 via the biasing members 33, 35. For example, a force applied by the operator 30 onto the clamp 16 (e.g., via the handle 17) in the first direction 18 being greater than the force applied by the bearings 36, 42 onto the clamp 16 in the second direction 20 may cause movement of the clamp 16 in the first direction 18. For this reason, the biasing members 33, 35 may be selected to provide a desirable amount of force that urges movement of the clamp 16 in the second direction 20 to secure the workpiece 26 while enabling movement of the clamp 16 in the first direction 18 (e.g., via a physically applied force, via bending of the workpiece 26). For instance, each of the biasing member 33, 35 may have a spring constant of 100 newton/meter (N/m) or 0.6 pounds/inch (lb/in), 200 N/m or 1.1 lb/in, 300 N/m or 1.7 lb/in, 400 N/m or 2.3 lb/in, 500 N/m or 2.9 lb/in, and so forth.

In some embodiments, different biasing members 33, 35 may be implemented for different applications, such as to secure different workpieces 26 for press brake operations. For example, for an implementation in which a surface area of contact between a workpiece 26 and the clamp 16 may be relatively low to result in reduced securement via a frictional force between the workpiece 26 and the clamp 16, biasing members 33, 35 that apply a relatively greater force on the clamp 16 in the second direction 20 may be used to increase securement of the workpiece 26 via the applied, compressive force. Indeed, different biasing member 33, 35, such as biasing members 33, 35 that may apply a different amount of force and/or extend a different length along the slots 32, 38, may be interchangeably installed in the table assembly 10.

To this end, the biasing members 33, 35 may be removably coupled from the rods 34, 40 (e.g., via the operator 30). By way of example, the rods 34, 40 may be coupled to the base 14 within the respective slots 32, 38 via fasteners (e.g., set screws), and the fasteners may be adjusted to decouple the rods 34, 40 from the base 14. Decoupling of the rods 34, 40 from the base 14 may enable decoupling of the bearings 36, 42 from the respective rods 34, 40 (e.g., by sliding the bearings 36, 42 off the rods 34, 40) and subsequent decoupling of the biasing members 33, 35 from the respective the rods 34, 40 (e.g., by sliding the biasing members 33, 35 off the respective rods 34, 40) to remove the biasing members 33, 35 from the table assembly 10. To install the biasing members 33, 35 to the table assembly 10, the biasing members 33, 35 may be coupled to the respective rods 34, 40 (e.g., by sliding the biasing members 33, 35 onto the respective rods 34, 40), the bearings 36, 42 may be coupled to the respective rods 34, 40 (e.g., by sliding the bearings 36, 42 onto the respective rods 34, 40), and coupling the rods 34, 40 to the base 14 within the respective slots 32, 38. However, the biasing members 33, 35 may be removed and/or installed in any other suitable matter in additional or alternative embodiments.

In further embodiments, other components may be used to move the clamp 16 along the base 14 and/or to bias the clamp 16. As an example, another type of spring (e.g., a gas spring, a hydraulic spring), a back drivable motor, a screw, another suitable component, or any combination may be utilized in addition to or as an alternative to the biasing members 33, 35. Such components may be manually operated by the operator 30. As another example, components, such as an actuator (e.g., a linear actuator) and/or a controller, that may automatically move the clamp 16 along the base 14 may be utilized. Such embodiments may further reduce operations manually performed by the operator 30 to prepare the workpiece 26 for press brake operations.

In some embodiments, the base 14 may have one or more mounting slots 44, which may be used to attach the table assembly 10 to the press brake system 12 or to any other suitable component or surface. For example, a respective mounting clamp 66 may couple to the table assembly 10 at the second surface 29 via one of the mounting slots 44, and the mounting clamp 66 may couple to the press brake system 12 to couple the table assembly 10 to the press brake system 12. The base 14 may also have one or more mounting holes 46. For instance, various inserts 45 (e.g., pins, blocks) may be coupled to the base 14 via the mounting holes 46. The inserts 45 may be utilized to position the workpiece 26 as desired. As an example, the workpiece 26 may abut against the inserts 45 to maintain the workpiece 26 in a desirable position while being secured by the clamp 16. That is, the inserts 45 may provide additional support for positioning the workpiece 26. Additionally or alternatively, the inserts 45 may be used to position the clamp 16 as desired. For example, the inserts 45 may block movement of the clamp 16 to a threshold distance in the first direction 18 (e.g., away from the backgauge 22) and/or a to a threshold distance in the second direction 20 (e.g., toward the backgauge 22).

Figure 5:
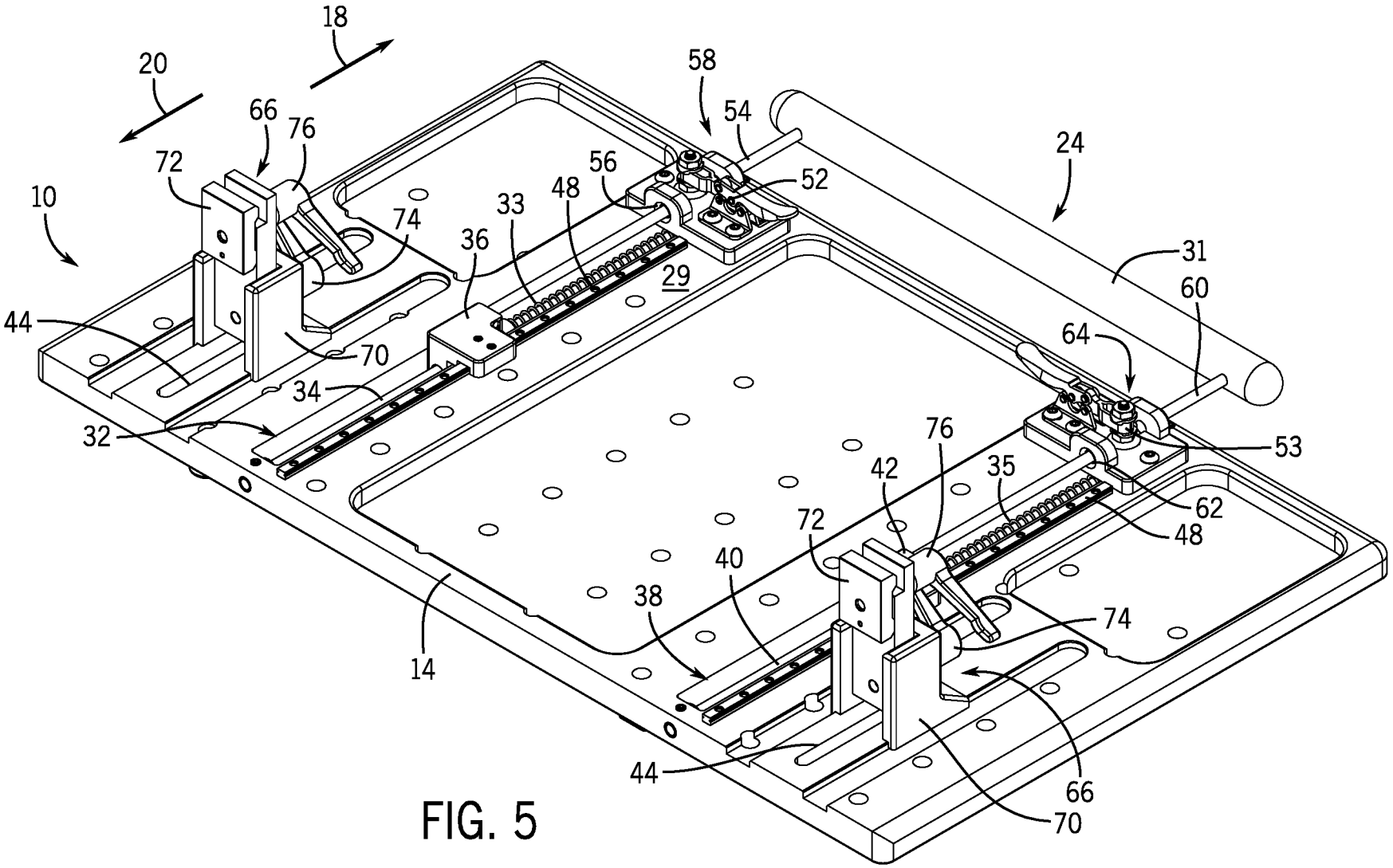
FIG. 5 is a bottom view of an embodiment of the table assembly of FIG. 1, in accordance with an aspect of the present disclosure.

FIG. 5 is a bottom view of an embodiment of the table assembly 10. As described herein, the first bearing 36 is coupled to the first rod 34 within the first slot 32, the second bearing 42 is coupled to the second rod 40 within the second slot 38, and the bearings 36, 42 may move along the respective rods 34, 40. Additionally, the base 14 may include guides 48 (e.g., ribs, rails, protrusions, extensions) that facilitate movement (e.g., translation) of the bearings 36, 42 along the base 14. For example, the each guide 48 may extend along the slots 32, 38, and each bearing 36, 42 may engage with (e.g., capture) and move along the guides 48. Engagement between the bearings 36, 42 may block certain movement of the bearings 36, 42, such as rotational movement about the respective rods 34, 40. As such, the guides 48 may facilitate movement of the bearings 36, 42 along the respective rods 34, 40 and respective slots 32, 38.

In the illustrated embodiment, the weight 31 of the weight balancing system 24 is connected to a first linkage 54 (e.g., a wire, a string, a rope, a thread, a line, a cable) and to a second linkage 60. The first linkage 54 may extend through a first hole 56 of a first mount 58 coupled to the base 14 at the second surface 29, and the second linkage 60 may extend through a second hole 62 of a second mount 64 coupled to the base 14 at the second surface 29. The first linkage 54 may be connected to the first bearing 36, and the second linkage 60 may be connected to the second bearing 42. In this manner, the weight 31 may exert a force (e.g., a tensile force) onto the bearings 36, 42 via the linkages 54, 60. For example, the weight 31 may exert the force onto the bearings 36, 42 in the first direction 18, and the force imparted onto the bearings 36, 42 may also be applied to the clamp 16 coupled to the bearings 36, 42.

In some embodiments, the first mount 58 may include a first lock 52, and the second mount 64 may include a second lock 53. The first lock 52 and the second lock 53 may be used to block movement of the respective linkages 54, 60 in the second direction 20, thereby blocking translation of the bearings 36, 42 and the clamp 16 in the second direction 20. For example, actuation of the locks 52, 53 to a locked configuration may block movement of the respective linkages 54, 60 through the holes 56, 62. As a result, movement of the bearings 36, 42 in the second direction 20 may stretch (e.g., tighten, elongate) the linkages 54, 60 instead of moving the linkages 54, 60 and the weight 31 relative to the base 14. The bearings 36, 42 may be moved in the second direction 20 by a threshold distance until the linkages 54, 60 are in a fully stretched configuration, and the linkages 54, 60 in the fully stretched configuration may block further movement of the bearings 36, 42 in the second direction 20. However, the linkages 54, 60 may enable movement of the bearings 36, 42 in the second direction 20 while the locks 52, 53 are actuated. For example, movement of the bearings 36, 42 in the first direction 18 may bend (e.g., slacken, flex) the linkages 54, 60 instead of moving the linkages 54, 60 and the weight 31 relative to the base 14. In this manner, the locked configuration of the locks 52, 53 may block certain movement of the clamp 16 in the second direction 20 (e.g., to position the clamp 16 at a threshold distance away from the backgauge 22), thereby limiting a range of movement of the clamp 16 along the base 14. The locks 52, 53 may also be adjusted to an unlocked configuration to enable movement of the linkages 54, 60 through the respective holes 56, 62 to enable greater movement of the clamp 16 along the base 14.

The weight 31 (e.g., having a particular mass) may be selected based on various parameters of the table assembly 10, such as strength of the linkages 54, 60, a weight of the clamp 16 and/or the bearings 36, 42, a force imparted by the biasing members 33, 35, and so forth. Thus, the weight 31 may provide a suitable amount of force in the first direction 18 to facilitate movement of the clamp 16 (e.g., via a physically applied force), positioning of the clamp 16 (e.g., relative to the backgauge 22), and the like. Although the illustrated table assembly 10 includes a single weight 31 attached to both linkages 54, 60, any suitable number of weights 31 may be utilized in additional or alternative embodiments, such as a separate weight 31 coupled to the individual linkages 54, 60.

Additionally, a respective mounting clamp system 66 may be coupled to each of the mounting slot 44 to secure the table assembly 10 to the press brake system 12. For example, each mounting clamp 66 may include a first mounting clamp 70 and a second mounting clamp 72. Each first mounting clamp 70 may be coupled to the base 14 via the mounting slots 44, and each second mounting clamp 72 may be coupled to the first mounting clamp 70 and to the press brake system 12, thereby coupling the base 14 to the press brake system 12. The first mounting clamp 70 and the second mounting clamp 72 may move (e.g., translate) relative to one another. For example, movement between the first mounting clamp 70 and the second mounting clamp 72 may cause movement of the base 14 relative to the press brake system 12, such as to adjust a height of the base 14. The first mounting clamp 70 may include a first mounting clamp lock 74 that may be actuated to block relative movement between the first mounting clamp 70 and the second mounting clamp 72, thereby blocking relative movement between the base 14 relative to the press brake system 12. Additionally, the second mounting clamp 72 may include a second mounting clamp lock 76 that may be actuated to secure the second mounting clamp 72, and therefore the base 14, to the press brake system 12. For example, the first mounting clamp lock 72 and/or the second mounting clamp lock 74 may be manually actuated by the operator 30.

In some embodiments, the mounting clamp systems 66 may be adjustably positioned about the mounting slots 44. As an example, the mounting clamp systems 66 may be arranged at any suitable position along the mounting slots 44, such as to move the mounting clamp systems 66 in the first direction 18 and/or in the second direction 20 relative to the base 14. Adjusting the positioning of the mounting clamp systems 66 in the mounting slots 44 may adjust a position of the table assembly 10 relative to the press brake system to which the mounting clamp systems 66 are coupled. For instance, moving the mounting systems 66 in the first direction 18 relative to the base 14 may move the base 14 away from the press brake system 12, and moving the mounting systems 66 in the second direction 20 relative to the base 14 may move the base 14 toward the press brake system 12. As such, the mounting clamp systems 66 may be positioned in any suitable manner in the mounting slots 44 to position the table assembly 10 in a suitable manner with respect to the press brake system 12.

Figure 6:
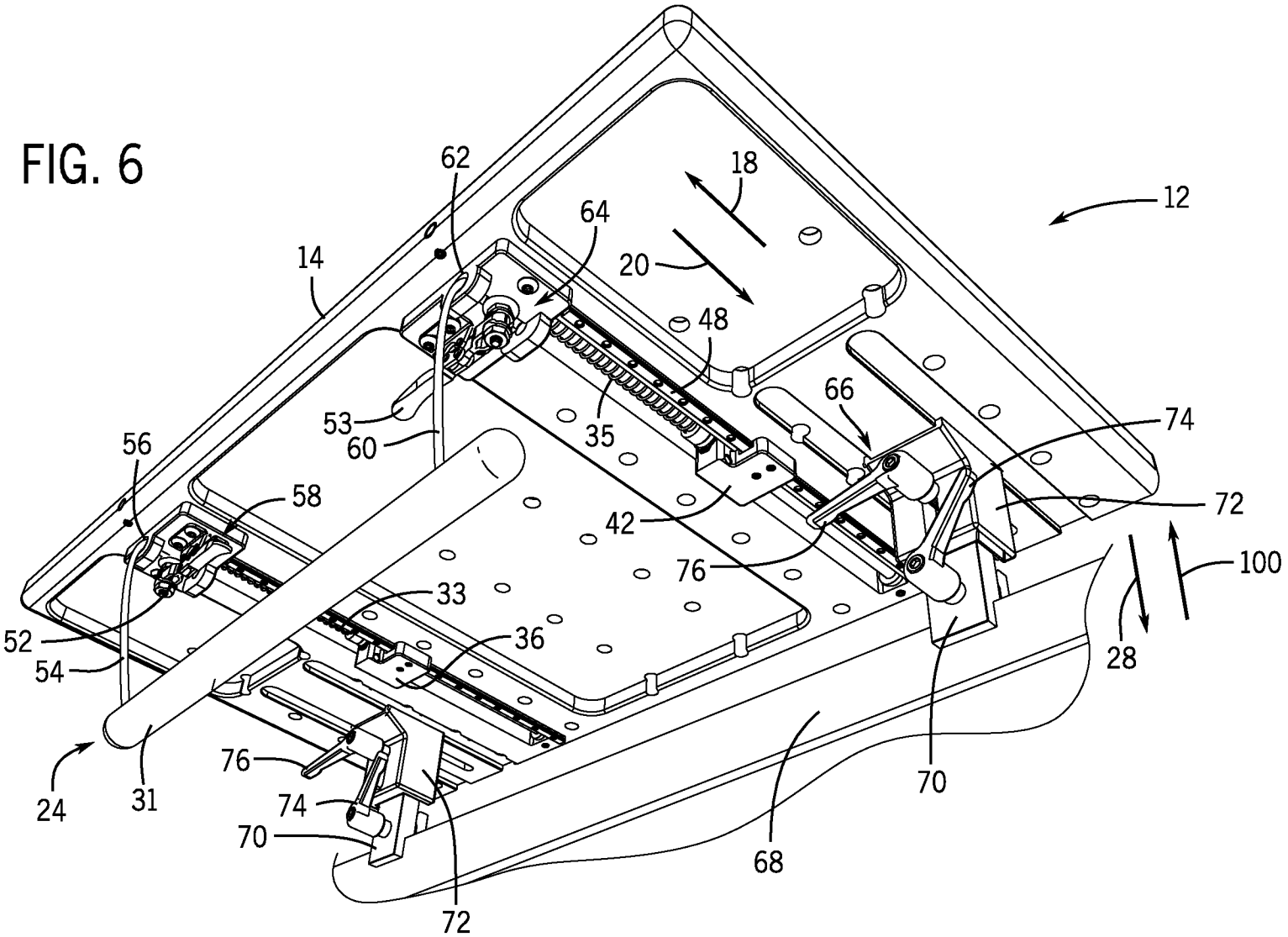
FIG. 6 is perspective bottom view of an embodiment of the table assembly of FIG. 1, in accordance with an aspect of the present disclosure.

FIG. 6 illustrates an embodiment of the table assembly 10 coupled to the press brake system 12 via the mounting clamps 66. For example, the second mounting clamps 72 be coupled to an existing part of the press brake system 12, such as a rail 68 that may be used to secure other accessories, such as a different support, to the press brake system 12. Thus, the table assembly 10 may be readily implemented in existing press brake systems 12 (e.g., without manufacture or purchase of an intermediate component to couple the table assembly 10 to a press brake system 12). Thus, an existing press brake system 12 may be retrofitted with the table assembly 10 to improve press brake operations associated with the press brake system 12.

As described herein, the mounting clamps 70, 72 may be movable relative to one another. For instance, the mounting clamps 70, 72 may move relative to one another to move the base 14 relative to the rail 68, such as in the third direction 28 (e.g., to lower the base 14 toward the rail 68) and/or in a fourth direction 100 (e.g., to raise the base 14 away from the rail 68). The position of the base 14 relative to the rail 68 may be adjusted to accommodate different workpieces 26, such as workpieces 26 having different geometries (e.g., heights, thicknesses), to enable performing press brake operations.

Thus, technical effects of the present disclosure relates to a table assembly used for metalworking, such as a press brake operation. The table assembly may reduce manual operations that may be performed by an operator to prepare for the press brake operation. Thus, the table assembly may improve efficiency and/or user experience associated with performing the press brake operation.

While specific embodiments and applications of the disclosure have been illustrated and described, it is to be understood that the disclosure is not limited to the precise configurations and components disclosed herein. Accordingly, many changes may be made to the details of the above-described embodiments without departing from the underlying principles of this disclosure. The scope of the present disclosure should, therefore, be determined only by the following claims.

Indeed, the embodiments set forth in the present disclosure may be susceptible to various modifications and alternative forms, specific embodiments have been shown by way of example in the drawings and have been described in detail herein. However, it may be understood that the disclosure is not intended to be limited to the particular forms disclosed. The disclosure is to cover all modifications, equivalents, and alternatives falling within the spirit and scope of the disclosure as defined by the following appended claims. In addition, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). For any claims containing elements designated in any other manner, however, it is intended that such elements are not to be interpreted under 35 U.S.C. 112(f).

What is claimed is:

1. A table assembly for a press brake system, comprising:

a base comprising a top surface, a bottom surface, and a slot extending from the top surface to the bottom surface, wherein the base is configured to support a workpiece of the press brake system; and a clamp coupled to a bearing below the slot configured to couple to the base and to move relative to the base, wherein the clamp is configured to translate in a first direction via a tension member connected to a weight to enable receipt of the workpiece via the table assembly, and the clamp is configured to bias against the workpiece via an elastic member in a second direction to block movement of the workpiece relative to the base.

2. The table assembly of claim 1, wherein the clamp is configured to bias the workpiece against a backgauge of the press brake system to capture the workpiece between the clamp and the backgauge and block movement of the workpiece relative to the base.

3. The table assembly of claim 1, comprising a biasing member configured to bias the clamp in the second direction to cause the clamp to bias against the workpiece in the second direction.

4. The table assembly of claim 3, wherein the base comprises the slot, and the table assembly comprises:

a rod extending along the base within the slot; and the bearing coupled to the rod and to the clamp, wherein the bearing is configured to translate along the rod to drive movement of the clamp relative to the base, and the biasing member is in engagement with the bearing to bias the bearing in the second direction, thereby biasing the clamp in the second direction.

5. The table assembly of claim 4, wherein the biasing member comprises the elastic member comprising a mechanical spring coiled around the rod.

6. The table assembly of claim 4, wherein the weight comprises part of a weight balancing system configured to couple to the bearing, wherein the weight balancing system is configured to impart a force on the bearing in the first direction to facilitate translation of the clamp in the first direction.

7. The table assembly of claim 6, wherein the weight balancing system comprises:

the weight; and a linkage coupling the weight to the bearing, wherein the weight is configured to tension the linkage in the first direction to cause the linkage to impart the force on the bearing in the first direction.

8. The table assembly of claim 7, comprising a mount coupled to the base, wherein the mount comprises a hole and a lock, the linkage extends through the hole, and the lock is configured to block movement of the linkage through the hole.

9. The table assembly of claim 8, wherein the lock is configured to adjust to a locked configuration to block the movement of the linkage through the hole, movement of the bearing in the first direction stretches the linkage in the locked configuration of the lock, and movement of the bearing in the second direction bends the linkage in the locked configuration of the lock.

10. The table assembly of claim 7, wherein the linkage comprises a wire, a string, a rope, a thread, a line, a cable, or any combination thereof.

11. A table assembly for a press brake system, comprising:

a base comprising a top surface, a bottom surface, and a slot extending from the top surface to the bottom surface, wherein the base is configured to support a workpiece of the press brake system;

a clamp coupled to a bearing below the slot configured to couple to the base, wherein the clamp is configured to translate in a first direction away from a backgauge of the press brake system, and the clamp translates in a second direction, via an elastic member, opposite the first direction, toward the backgauge to abut the workpiece of the press brake system against the backgauge; and a weight balancing system coupled to the clamp via a tension member connected to the bearing and configured to apply a force onto the clamp in the first direction to facilitate translation of the clamp in the first direction.

12. The table assembly of claim 11, wherein the clamp comprises a step-shaped profile having a first portion and a second portion, the first portion includes a first thickness, and the second portion includes a second thickness greater than the first thickness.

13. The table assembly of claim 12, wherein the first portion is configured to abut against the workpiece, and the second portion is coupled to a handle.

14. The table assembly of claim 11, comprising a first mounting clamp and a second mounting clamp, wherein the first mounting clamp is coupled to the base, the second mounting clamp is coupled to the press brake system, and the first mounting and the second mounting clamp are configured to move relative to one another to move the base relative to the press brake system.

15. A table assembly for a press brake system, comprising:

a base;

an elastic biasing member;

a clamp configured to translate in a first direction and in a second direction, opposite the first direction, relative to the base, wherein the biasing member is coupled to a bearing below the base aligned with a slot and the bearing is configured to bias the clamp in the second direction; and a weight balancing system coupled to the clamp via the bearing through a tension member and configured to apply a force to the clamp in the first direction.

16. The table assembly of claim 15, comprising:

a rod coupled to the base; and the bearing coupled to the rod and the clamp, wherein the bearing is configured to translate along the rod and relative to the base to drive corresponding movement of the clamp relative to the base.

17. The table assembly of claim 16, wherein the biasing member is coupled to the rod and is configured to bias the bearing in the second direction to bias the clamp in the second direction.

18. The table assembly of claim 16, wherein the clamp is configured to translate along a first surface of the base, and the bearing is configured to translate along a second surface, opposite the first surface, of the base.

19. The table assembly of claim 16, comprising a guide, wherein the bearing is configured to engage with the guide, and the guide is configured to block rotation of the bearing about the rod.

20. The table assembly of claim 15, wherein translation of the clamp in the first direction increases a distance between the clamp and a backgauge of the press brake system, and translation of the clamp in the second direction reduces the distance between the clamp and the backgauge.

* * * * *